US008215914B2

(12) United States Patent
Danescu et al.

(10) Patent No.: US 8,215,914 B2
(45) Date of Patent: Jul. 10, 2012

(54) COMPLIANT SEAL FOR ROTOR SLOT

(75) Inventors: Radu Ioan Danescu, Greenville, SC (US); John D. Ward, Woodruff, SC (US)

(73) Assignee: General Electric Company, Schenectady, NY (US)

( * ) Notice: Subject to any disclaimer, the term of this patent is extended or adjusted under 35 U.S.C. 154(b) by 1228 days.

(21) Appl. No.: 12/168,942

(22) Filed: Jul. 8, 2008

(65) Prior Publication Data

US 2010/0008782 A1 Jan. 14, 2010

(51) Int. Cl.
*F03B 3/12* (2006.01)

(52) U.S. Cl. ..... 416/219 R

(58) Field of Classification Search ..... 416/219 R
See application file for complete search history.

(56) References Cited

U.S. PATENT DOCUMENTS

| | | | | |
|---|---|---|---|---|
| 3,709,631 | A | 1/1973 | Karstensen et al. | |
| 4,326,835 | A * | 4/1982 | Wertz | 416/193 A |
| 4,422,827 | A | 12/1983 | Buxe et al. | |
| 4,480,957 | A | 11/1984 | Patel et al. | |
| 4,494,909 | A | 1/1985 | Forestier | |
| 4,725,200 | A | 2/1988 | Welhoelter | |
| 4,743,164 | A | 5/1988 | Kalogeros | |
| 4,743,166 | A | 5/1988 | Elston, III et al. | |
| 5,052,890 | A | 10/1991 | Roberts | |
| 5,052,893 | A | 10/1991 | Catte | |
| 5,139,389 | A | 8/1992 | Eng et al. | |
| 5,257,909 | A | 11/1993 | Glynn et al. | |
| 5,599,170 | A | 2/1997 | Marchi et al. | |
| 5,823,743 | A | 10/1998 | Faulkner | |
| 6,273,683 | B1 | 8/2001 | Zagar et al. | |
| 6,296,172 | B1 | 10/2001 | Miller | |
| 6,375,429 | B1 * | 4/2002 | Halila et al. | 416/193 A |
| 6,565,322 | B1 | 5/2003 | Lieser et al. | |
| 6,575,704 | B1 | 6/2003 | Tiemann | |
| 6,682,307 | B1 | 1/2004 | Tiemann | |
| 2010/0068063 | A1 * | 3/2010 | Berg et al. | 416/223 A |

FOREIGN PATENT DOCUMENTS

| | | | |
|---|---|---|---|
| EP | 0774048 | A1 | 5/1997 |
| WO | 9412772 | A1 | 6/1994 |

* cited by examiner

*Primary Examiner* — Richard Elms
*Assistant Examiner* — Harry W Byrne
(74) *Attorney, Agent, or Firm* — Sutherland Asbill & Brennan LLP

(57) ABSTRACT

A compliant seal assembly for sealing a gap between a dovetail tab of a bucket and a slot of a rotor. The compliant sealing assembly may include a sealing groove positioned about the slot and a compliant seal positioned about the sealing groove. The compliant seal is forced into the gap and about the dovetail tab when the bucket rotates.

18 Claims, 3 Drawing Sheets

COMPLIANT SEAL FOR ROTOR SLOT

TECHNICAL FIELD

The present application relates generally to any type of turbine and more particularly relates to systems and methods for sealing a gap between a turbine blade dovetail and a turbine rotor slot via a compliant seal.

BACKGROUND OF THE INVENTION

Gas turbines generally include a turbine rotor (wheel) with a number of circumferentially spaced buckets (blades). The buckets generally may include an airfoil, a platform, a shank, a dovetail, and other elements. The dovetail of each bucket is positioned within the turbine rotor and secured therein. The airfoils project into the hot gas path so as to convert the kinetic energy of the gas into rotational mechanical energy. A number of cooling medium passages may extend radially through the bucket to direct an inward and/or an outward flow of the cooling medium therethrough.

Leaks may develop in the coolant supply circuit based upon a gap between the tabs of the dovetails and the surface of the rotor due to increases in thermal and/or centrifugal loads. Air losses from the bucket supply circuit into the wheel space may be significant with respect to blade cooling medium flow requirements. Moreover, the air may be extracted from later compressor stages such that the penalty on energy output and overall efficiency may be significant during engine operation.

Efforts have been made to limit this leak. For example, one method involves depositing aluminum on a dovetail tab so as to fill the gap at least partially. Specifically, a 360-degree ring may be pressed against the forward side of the dovetail face. Although this design seals well and is durable, the design cannot be easily disassembled and replaced in the field. Rather, these rings may only be disassembled when the entire rotor is disassembled.

There is thus a desire for improved dovetail tab sealing systems and methods. Such systems and methods should adequately prevent leakage therethrough so as to increase overall system efficiency while being installable and/or repairable in the field.

SUMMARY OF THE INVENTION

The present application thus describes a compliant seal assembly for sealing a gap between a dovetail tab of a bucket and a slot of a rotor. The compliant sealing assembly may include a sealing groove positioned about the slot and a compliant seal positioned about the sealing groove. The compliant seal is forced into the gap and about the dovetail tab when the bucket rotates.

The present application further provides a method of sealing a gap between a dovetail tab of a bucket and a slot of a rotor. The method may include the steps of machining a sealing groove about the slot of the rotor, positioning a compliant seal about the sealing groove, rotating the bucket, and forcing the compliant seal into the gap and about the dovetail tab.

The present application further provides for a compliant seal assembly for sealing a gap between a dovetail tab of a bucket and a slot of a rotor. The compliant seal assembly may include a sealing groove positioned about the slot and a compliant seal positioned about the sealing groove. The compliant seal is forced into the gap via centrifugal force and conforms about the dovetail tab when the bucket rotates.

These and other features of the present application will become apparent to one of ordinary skill in the art upon review of the following detailed description when taken in conjunction with the several drawings and the appended claims.

DETAILED DESCRIPTION

Figure 1A:
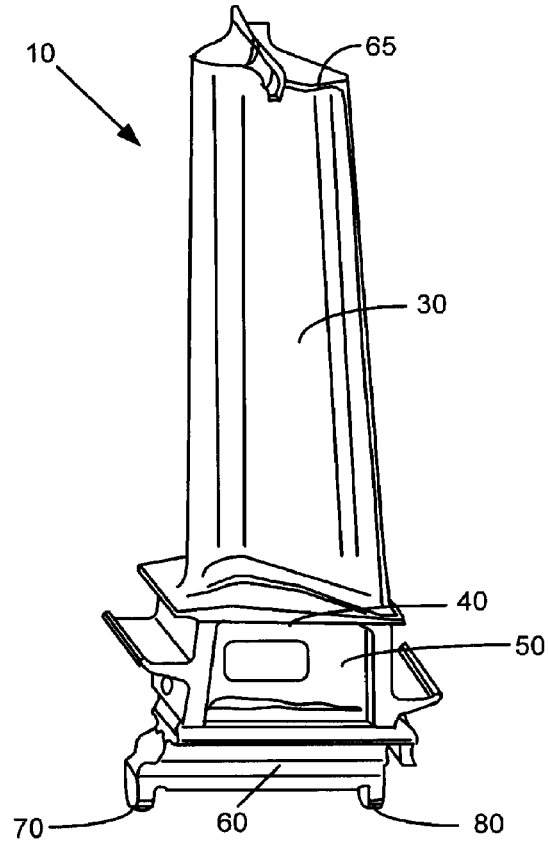
FIG. 1A is a perspective view of a bucket with a shroud that may be used with the sealing systems as are described herein.
Figure 2:
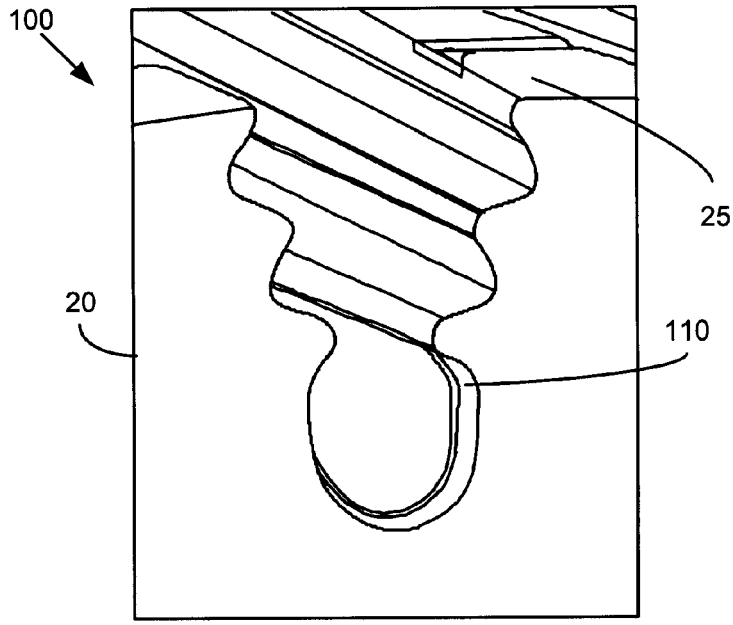
FIG. 2 is a perspective view of a rotor sealing slot of the compliant seal system as is described herein.

Referring now to the drawings, in which like numerals refer to like elements throughout the several views, FIG. 1A shows a bucket 10 as may be used herein. The bucket 10 may be a first or a second stage bucket as used in a 7FA+e gas turbine sold by General Electric Company of Schenectady, N.Y. Any other type of bucket or stage also may be used herein. The bucket 10 may be used with a rotor 20 as is shown in FIG. 2.

Figure 1B:
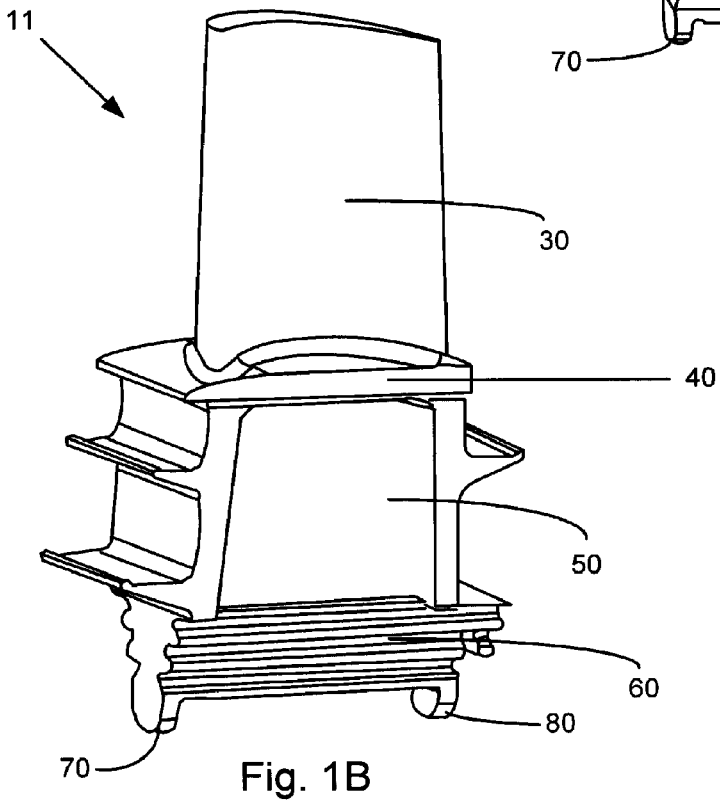
FIG. 1B is a perspective view of a bucket without a shroud that may be used with the sealing systems as are described herein.

As is known, the bucket 10 may include an airfoil 30, a platform 40, a shank 50, a dovetail 60, and other elements. It will be appreciated that the bucket 10 is one of a number of circumferentially spaced buckets 10 secured to and about the rotor 20 of the turbine. The bucket 10 of FIG. 1A has a shroud 65 on one end of the airfoil 30. The bucket 11 of FIG. 1B lacks the shroud. Any other type of bucket design may be used herein.

As described above, the rotor 20 may have a number of slots 25 for receiving the dovetails 60 of the buckets 10. Likewise, the airfoils 30 of the buckets 10 project into the hot gas stream so as to enable the kinetic energy of the stream to be converted into mechanical energy through the rotation of the rotor 20. The dovetail 60 may include a first tang or tab 70 and a second tab 80 extending therefrom. Similar designs may be used herein. A gap 90 may be formed between the ends of the tabs 70, 80 of the dovetail 60 and the rotor 20. A high pressure cooling flow may escape via the gap 90 unless a sealing system of some type is employed.

FIGS. 2-6 show a compliant sealing system 100 as is described herein. The compliant sealing system 100 may be positioned about each of the slots 25 described above of the rotor 20. Each slot 25 may include a sealing groove 110. The sealing groove 110 may extend about the perimeter of the slot 25. The dimensions and shape of the sealing groove 110 may vary. The sealing groove 110 may be formed with conventional machining techniques. Other types of manufacturing techniques also may be used herein. The sealing groove 110 may have a square or a circular cross-sectional shape. Alternatively, any desired cross-sectional shape may be used herein.

A compliant seal 120 may be positioned within the sealing slot 110. The compliant seal 120 may be made out of any type of metallic, elastic seal material. The compliant seal 120 may be largely U-shaped and may conform to the shape of the sealing groove 110, i.e., the compliant seal 120 may have a square or circular cross-section or any desired cross-sectional shape.

Figure 3:
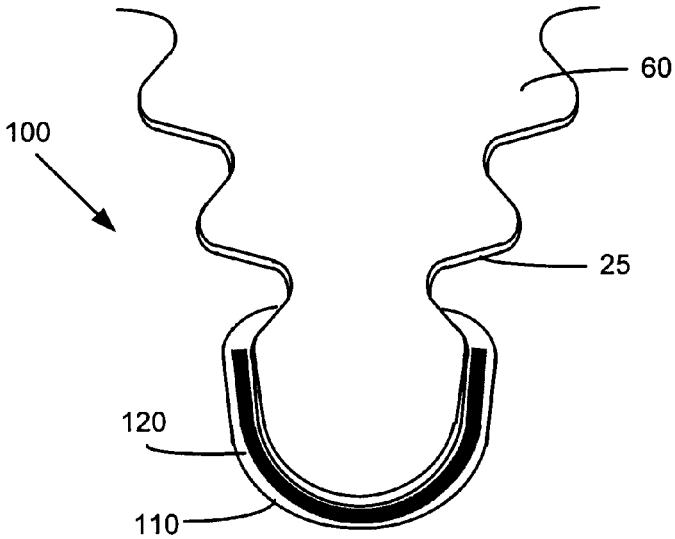
FIG. 3 is a side cross-sectional view of the compliant sealing system of FIG. 2 at a stationary position.
Figure 5:
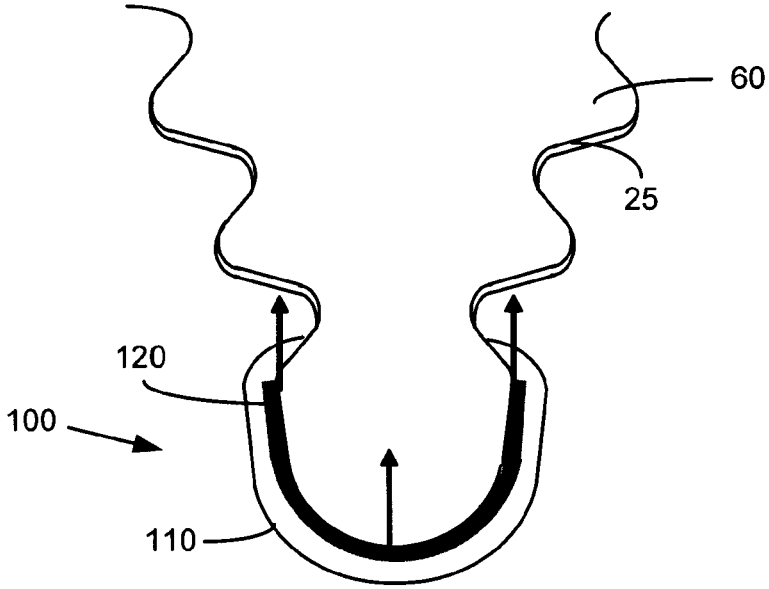
FIG. 5 is a side cross-sectional view of the compliant sealing system of FIG. 2 at high speed.

As is shown in FIG. 3, the compliant seal 120 remains within the sealing groove 110 when the bucket 10 is stationary such that the bucket 10 can be easily installed or removed. In use at full or high speed as shown in FIG. 5, centrifugal load on the seal 120 moves the seal 120 outward so as to press it against the tab 70 of the dovetail 60. The centrifugal load further deforms the seal 120 to make it compliant about the tab 70 of the dovetail 60.

Figure 4:
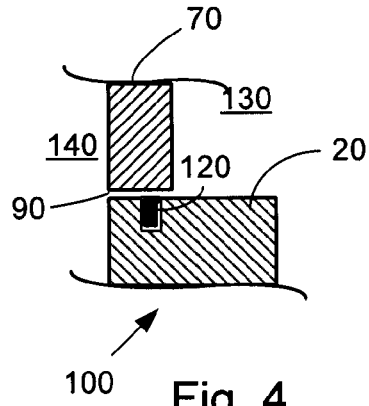
FIG. 4 is a further side cross-sectional view of the complaint sealing system of FIG. 2 at a stationary position.
Figure 6:
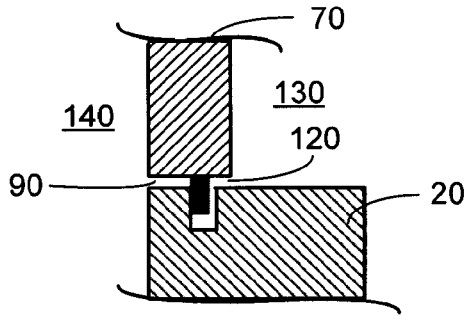
FIG. 6 is a further side cross-sectional view of the compliant sealing system of FIG. 2 at high speed.

As is shown in FIGS. 4 and 6, the compliant seal 100 is positioned between a high-pressure side 130 and a low-pressure side 140 of the dovetail 60. The compliant seal 120 thus may fill the gap 90 so as to prevent leakage from the cooling supply air on the high-pressure side 130 to the wheel space on the low-pressure side 140 when at full or high speed due to inertia.

Use of the complaint sealing system 100 thus reduces leakage through the gap 90. Moreover, the use of the compliant seal 120 addresses the larger variations in the size range of the gap 90. No modifications are required to the bucket 10 or the rotor 20. Sealing efficiency similar to that of the commonly used aluminum coating thus may be found or improved upon without the use of the additional mass of material. The reduction in cooling flow loss thus improves overall system efficiency. High-pressure air savings may be about one percent (1%) or so. The compliant sealing system 100 may be used with other sealing systems and methods.

It should be apparent that the foregoing relates only to certain embodiments of the present application and that numerous changes and modifications may be made herein by one of ordinary skill in the art without departing from the general spirit and scope of the invention as defined by the following claims and the equivalents thereof.

We claim:

1. A compliant seal assembly for sealing a gap between a dovetail tab of a bucket and a slot of a rotor, comprising:

a sealing groove positioned in a radial plane about an inner surface of the slot; and a compliant seal positioned radially about the sealing groove such that the compliant seal is forced radially outward into the gap and about a radial inner surface of the dovetail tab when the bucket rotates.

2. The compliant seal assembly of claim 1, wherein the sealing groove extends about a radial perimeter of the slot in whole or in part.

3. The compliant seal assembly of claim 1, wherein the compliant seal comprises a metallic, elastic material.

4. The compliant seal assembly of claim 1, wherein the compliant seal and the sealing groove both comprise a substantially square cross-section.

5. The compliant seal assembly of claim 1, wherein the compliant seal and the sealing groove both comprise a substantially circular cross-section.

6. The compliant seal assembly of claim 1, wherein the compliant seal comprises a substantial U-shape.

7. The compliant seal assembly of claim 1, wherein the compliant seal conforms about the radial inner surface of the dovetail tab when in contact therewith.

8. The compliant seal assembly of claim 1, further comprising a plurality of dovetail tabs.

9. A method of sealing a gap between a dovetail tab of a bucket and a slot of a rotor, comprising:

machining a sealing groove in a radial plane about an inner surface of the slot of the rotor;

positioning a compliant seal radially about the sealing groove;

rotating the bucket; and forcing the compliant seal radially outward into the gap and about a radial inner surface of the dovetail tab.

10. The method of claim 9, wherein the step of machining the sealing groove comprises machining a sealing groove with a substantially square cross-section.

11. The method of claim 9, wherein the step of machining the sealing groove comprises machining a sealing groove with a substantially circular cross-section.

12. A compliant seal assembly for sealing a gap between a dovetail tab of a bucket and a slot of a rotor, comprising:

a sealing groove positioned in a radial plane about an inner surface of the slot; and a compliant seal positioned radially about the sealing groove such that the compliant seal is forced radially outward into the gap via centrifugal force and conforms about a radial inner surface of the dovetail tab when the bucket rotates.

13. The compliant seal assembly of claim 12, wherein the sealing groove extends radially about a perimeter of the slot in whole or in part.

14. The compliant seal assembly of claim 12, wherein the compliant seal comprises a metallic, elastic material.

15. The compliant seal assembly of claim 12, wherein the compliant seal and the sealing groove both comprise a substantially square cross-section.

16. The compliant seal assembly of claim 12, wherein the compliant seal and the sealing groove both comprise a substantially circular cross-section.

17. The compliant seal assembly of claim 12, wherein the compliant seal comprise a substantial U-shape.

18. The compliant seal assembly of claim 12, further comprising a plurality of dovetail tabs.

* * * * *